US007352376B2

(12) United States Patent
Holland

(10) Patent No.: US 7,352,376 B2
(45) Date of Patent: Apr. 1, 2008

(54) APPARATUS AND METHOD FOR ELECTROPHORETIC PRINTING DEVICE

(75) Inventor: William D. Holland, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 492 days.

(21) Appl. No.: 11/092,512

(22) Filed: Mar. 29, 2005

(65) Prior Publication Data

US 2006/0221169 A1 Oct. 5, 2006

(51) Int. Cl.
*B41J 2/41* (2006.01)

(52) U.S. Cl. ..... 347/120

(58) Field of Classification Search ..... 347/112, 347/120, 123

See application file for complete search history.

(56) References Cited

U.S. PATENT DOCUMENTS 5,923,412 A * 7/1999 Ertel ..... 355/400
6,861,365 B2 3/2005 Taussig et al.
6,895,200 B2 * 5/2005 Tagansky ..... 399/240

* cited by examiner

*Primary Examiner*—Huan Tran

(57) ABSTRACT

An electrode array with embedded thin-film transistors is fabricated with a self-aligned imprint lithography process. In an embodiment the electrode array is built over a flexible, conductive, substrate, in an alternative embodiment the electrode array is built on a curved substrate. In an embodiment, the electrode array is incorporated into a printer, and is coated with a passivation layer having openings for each electrode of the array. The printer develops an image by selectively charging electrodes of the array, the openings of each electrode being exposed to an electrophoretic ink. Charged particles of the electrophoretic ink migrate to charged electrodes, thereby forming an image that is transferred to a printing substrate such as paper.

14 Claims, 7 Drawing Sheets

APPARATUS AND METHOD FOR ELECTROPHORETIC PRINTING DEVICE

FIELD

The present document relates to the field of apparatus for liquid electrophotography.

BACKGROUND

Liquid Electrophotography

In liquid electrophotography, an electrostatic latent image is formed on a photoconductor. A liquid toner containing charged ink particles is applied to the latent image, which is developed as ink particles move via a process of electrophoresis to the latent image. The developed image is then transferred to paper or another printing substrate.

Electrophoresis is use of an electric field to move charged particles in a fluid. In electrophoresis, particle movement is typically a function of particle charge, particle mobility, and electric field strength. The force on a particle from the electric field is the product of its charge and the electric field strength ($F=q\times E$). The viscous drag on a particle is the negative ratio of its charge times its velocity divided by its mobility ($F=-q\times v/\mu$). When a field is applied, charged particles will accelerate until the drag balances the force, resulting in a particle velocity proportional to applied field strength ($v=\mu\times E$).

Hewlett-Packard's Indigo Division produces commercial digital printing presses. The presses are based upon liquid electrophotography, using an ink (such as ElectroInk®, trademark of Hewlett-Packard corp.) containing electrically charged ink particles in an oil based liquid medium. Electrophoresis is used to develop electrostatic latent images on a photoconductive drum.

The prior electrophoretic printing process includes the following steps, which are spaced around the circumference of the rotating photoconductive drum:

1. Charging. The drum is charged, typically via a corona charging unit with grid electrode, to about −1000 volts.

2. Exposure. The electrostatic charge on the surface of the drum is discharged on illuminated portions of the drum by applying image-wise patterned light, typically via a modulated diode laser and a rotating polygon optical scanner, to about 0 volts. Unilluminated portions of the drum surface remain charged.

3. Development. A narrow gap is formed between the drum and a development electrode biased to about −500 volts. The gap is filled with ink containing a dispersion of negatively charged ink particles in an oil based liquid medium. The electric field points in one direction over the discharged areas of the drum (from electrode at −500 volts to drum at 0 volts) and in the other direction over the charged areas of the drum (from drum at −1000 volts to electrode at −500 volts). The electric field causes negatively charged ink particles to move electrophoretically away from the electrode to the discharged areas of the drum, developing the latent image on the drum. The electric field also causes negatively charged ink particles to move away from the charged areas of the drum towards the electrode, forming a negative of the image. The electrode is cleaned and these negative-image ink particles are removed.

5. Squeegee. Ink particles that have not become part of the image on the drum are removed, along with most of the oil.

6. First Transfer. The developed image is transferred from the drum to a blanket or other intermediate transfer member.

7. Drying and Heating. Dry the developed image with heat and air to remove any remaining oil and to film-form it by melting the plastic polymers in the ink particles.

8. Second transfer. Transfer the developed image from the blanket to paper or other substrate, where it fuses on contact with the (relatively cold) substrate.

9. Cleaning. The photoconductor is erased with light (typically using an LED light bar) to prevent image memory effects. The photoconductor and blanket are cleaned to remove excess oil and leftover traces of ink.

Low Voltage Electrophoresis

Charged particles move in an electric field at a velocity proportional to the product of their charge, the electric field strength and their mobility ($v=\mu\times E$). Therefore, charged particles can move just as far under low voltage conditions as under high voltage conditions, but require more time to move. It is therefore desirable that the drum and backing electrode be flexible such that these can be in contact for a significant proportion of a printer cycle if low-voltage electrophoresis is to be used.

Conventional Lithography is Difficult on Curved or Flexible Substrates

A rigid substrate is typically used during fabrication of integrated circuitry. This rigid substrate is typically a silicon wafer, although many display devices, such as thin-film-transistor (TFT) liquid-crystal display (LCD) panels, are fabricated on flat glass substrates. Typically, circuitry is fabricated as multiple layers, with each layer being defined through a separately applied and exposed layer of patterned photoresist. The patterns on each layer of patterned photoresist typically must be aligned to patterns on the prior layer so that the layers of the eventual devices are in functional relative positions.

With conventional integrated circuit photolithography, rigidity and flatness in the substrate is desirable because as a flexible substrate bends, its surface stretches. As a surface stretches, precise alignment of successive patterns to prior patterns already on the substrate becomes difficult. Similarly, fabrication of semiconductor devices on a surface that is not flat poses issues with focus. Fabrication of semiconductor devices on cylindrical or flexible belt substrates is impractical with typical photolithographic processes.

SUMMARY

This invention provides an apparatus and method for an electrophoretic printing device.

In particular, and by way of example only, according to an embodiment of the present invention, provided is an electrographic printer including: an electrode array further including a plurality of row lines, a plurality of data lines perpendicular to the row lines, and a plurality of thin-film transistors having a source at the data lines, drain at electrodes of the array, and gates at the row lines; a processor for placing a voltage selected from at least a first and a second voltages on each of the plurality of data lines of the electrode array and for driving the row lines of the array; a first ink applicator for applying electrophoretic ink to the electrode array, the electrophoretic ink including charged particles in a liquid component; a development electrode charged to a third voltage for developing an image of charged ink particles; image transfer apparatus for transferring the image to a printing substrate; and ink removal apparatus for removing excess ink from the electrode array.

BRIEF DESCRIPTION OF THE DRAWINGS

FIG. 5(*b*) The electrode array after isolation etch;

FIG. 5(*c*) The electrode array after implantation of source/drain regions and addition of source metal;

FIG. 5(*d*) The electrode array after shorting implant;

FIG. 6(*b*) The electrode array after deep isolation etch;

FIG. 6(*c*) The electrode array after implantation of source/drain regions and addition of second metal;

FIG. 6(*d*) The electrode array after shorting implant; and

FIG. 6(*e*) The electrode array after patterning gate metal.

DETAILED DESCRIPTION

Figure 1:
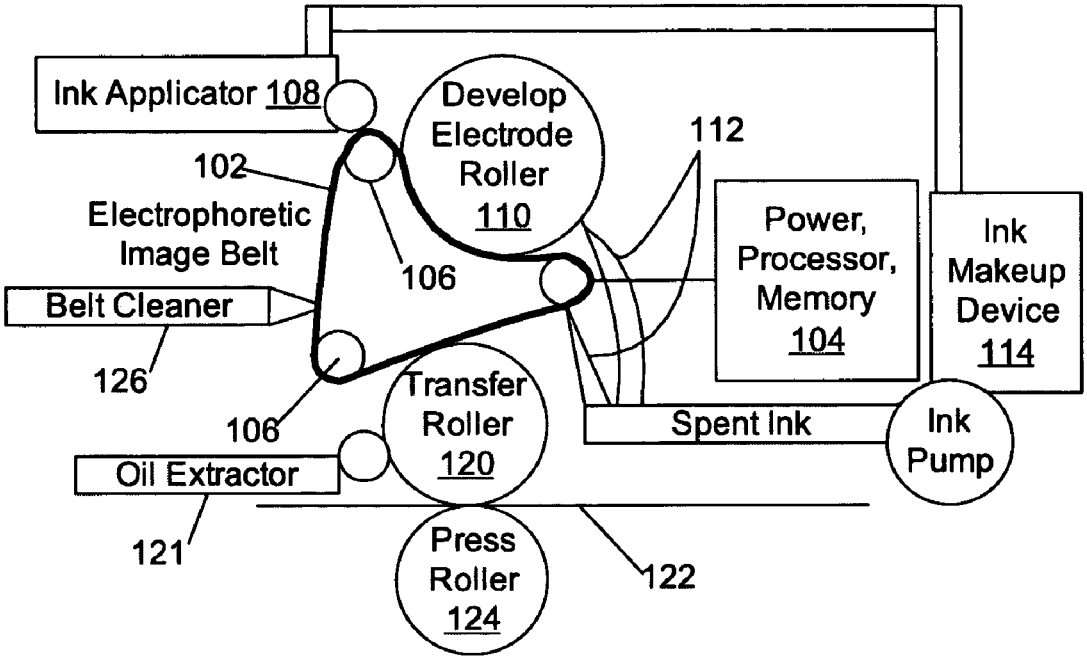
FIG. 1 is a simplified diagram of a printer embodying the electrode array.

An electrophoretic printer as illustrated in FIG. 1 has an electrophoretic electrode array fabricated on the surface of an electrophoretic image belt 102. The electrophoretic electrode array of image belt 102 is addressed and controlled by power, processor, and memory circuitry 104. Image belt 102 continually rotates around rollers 106. As image belt 102 rotates (counterclockwise in the figure) through its path, each electrode of the electrode array passes by an ink applicator 108 whereby a film of ink, the ink containing charged ink particles suspended in a liquid component such as an oil, is applied to the image belt 102. The image belt then wraps around development electrode roller 110; and an electric field across the ink is maintained between selected electrodes of the electrode array and the development electrode roller to develop an image on the image belt 102.

Spent ink is removed from the surface of the image belt 102 by spent ink removal device 112, and pumped through an ink makeup device 114. Ink makeup device 114 adds sufficient charged particles from an ink concentrate to the ink to restore residual ink to a usable concentration. Ink from the ink makeup device 114 flows to the ink applicator 108.

The developed image on the image belt 102 is transferred from the image belt 102 to a transfer roller 120. The transfer roller 120 rotates under an oil extractor 121, where heat and moving air remove oil from the image, and melt the ink particles into an ink film. The ink film image is then transferred from the transfer roller 120 to printing substrate 122 pressed against transfer roller 120 by a press roller 124. Printing substrate 124 includes paper as well as other common printing substrates such as cloth and plastic film. Additional intermediate transfer rollers may be used. The printing substrate 122 is fed into transfer roller 120 and press roller 124 by printing substrate handling equipment known in the art (not shown). Similarly, once the image is transferred to the printing substrate 122, the printing substrate 122 is stacked and stapled by more printing substrate handling apparatus known in the art (not shown).

Ink residue is cleaned from the belt by belt cleaner 126, each position on the belt then repeats the process.

Figure 2:
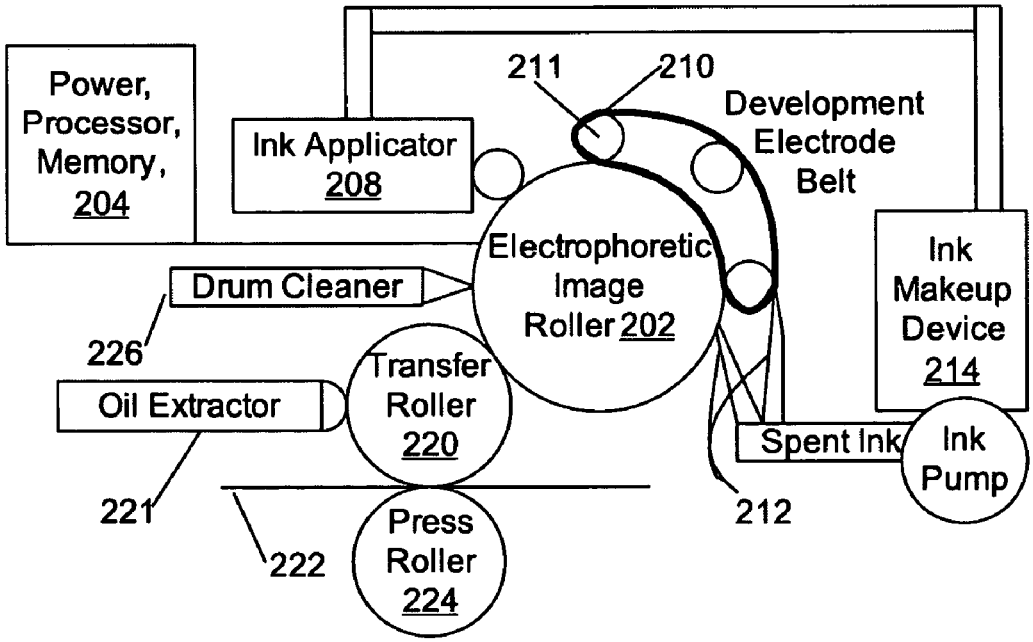
FIG. 2 is a simplified diagram of an alternative printer embodying the electrode array.

In an alternative embodiment of the printer as illustrated in FIG. 2 there is an electrophoretic electrode array fabricated on the surface of an electrophoretic image roller 202. The electrophoretic electrode array of image roller 202 is addressed and controlled by power, processor, and memory circuitry 204. Image roller 202 continually rotates. As image roller 202 rotates, each electrode of the electrode array passes by an ink applicator 208 whereby a film of ink, the ink containing charged ink particles in a liquid component such as an oil, is applied to the image roller 202. The image roller then has development electrode belt 210 wrapped around it by idler rollers 211; and an electric field across the ink is maintained between selected electrodes of the electrode array on image roller 202 and the development electrode belt 210 to develop an image on the image roller 202.

Spent ink is removed from the surface of the image roller 202 by spent ink removal device 212, and pumped through an ink makeup device 214. Ink makeup device 214 adds sufficient charged ink particles from an ink concentrate to the ink to restore residual ink to a usable concentration. Ink from ink makeup device 214 flows back to the ink applicator 208 for reuse.

The developed image on the image roller 202 is transferred from the image roller 202 to a transfer roller 220. The image passes beneath an oil extractor 221 where heat and moving air are used to remove most of the liquid component of the ink. The image is then transferred from the transfer roller 220 to a printing substrate 222 that is pressed against the transfer roller 220 by press roller 224. Additional intermediate transfer rollers, blankets, or belts may be used. After each portion of the image is transferred from image roller 202 to the transfer roller 220, the transfer roller rotates under a drum cleaning device 226 where residual ink is removed from image roller 202

Figure 2A:
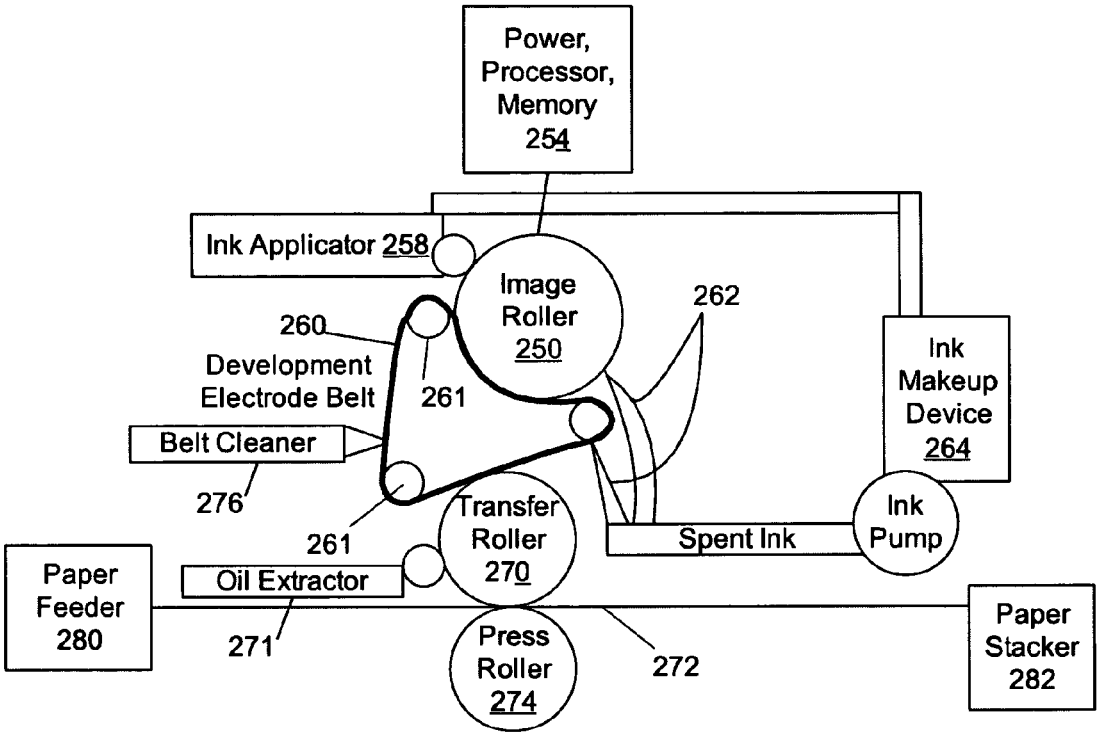
FIG. 2A is a simplified diagram of an alternative printer wherein the image is printed from the development electrode.

In an alternative embodiment of the printer as illustrated in FIG. 2A there is an electrophoretic electrode array fabricated on the surface of an electrophoretic image roller 250. The electrophoretic electrode array of image roller 250 is addressed and controlled by power, processor, and memory circuitry 254. Image roller 250 continually rotates, counterclockwise in the figure. As image roller 250 rotates, each electrode of the electrode array passes by an ink applicator 258 whereby a film of ink, the ink containing charged particles in a liquid component such as oil, is applied to the image roller 250. The image roller then has development electrode belt 260 wrapped around it by idler rollers 261; and an electric field across the ink is maintained between selected electrodes of the electrode array on image roller 250 and the development electrode belt 260 to develop a positive image on the development electrode 260 with a complementary negative image on the image roller 250.

Spent ink is removed from the surface of the image roller 260 by spent ink removal device 262, and pumped through an ink makeup device 264. Ink makeup device 264 adds sufficient charged particles from an ink concentrate to the ink to restore residual ink to a usable concentration. Ink from ink makeup device 264 flows back to the ink applicator 258 for reuse.

The developed image on the development electrode 260 is transferred from the development electrode 260 to a transfer roller 270. The image passes beneath an oil extractor 271 where heat and moving air are used to remove most of the liquid component of the ink and melt the ink particles so that they will readily fuse to a printing substrate. The image is then transferred from the transfer roller 270 to a printing substrate 272 that is pressed against the transfer roller 270 by press roller 274. After each portion of the image is transferred from development electrode 260 to the transfer roller 270, the development electrode is cleaned of residual ink by drum cleaning device 276 as it is recycled.

The printing substrate 272 is fed into transfer roller 270 and press roller 274 by printing substrate handling equipment such as paper feeder 280. Similarly, once the image is transferred to the printing substrate 272, the printing substrate 272 is stacked and stapled by a paper stacker 282 or paper stacking and stapling device.

It is anticipated that the electrophoretic image belt 102 of FIG. 1, or the electrophoretic image drum 202 of FIG. 2, incorporates decoder and driver electronic circuitry suitable for decoding electronic images received from the power, processor, and memory circuitry 104, 204 and for driving the electrodes of the electrode array. The processor 104, 204, with this decoder and driver circuitry, places determined voltages on the electrodes of the array according to the desired image.

Figure 3:
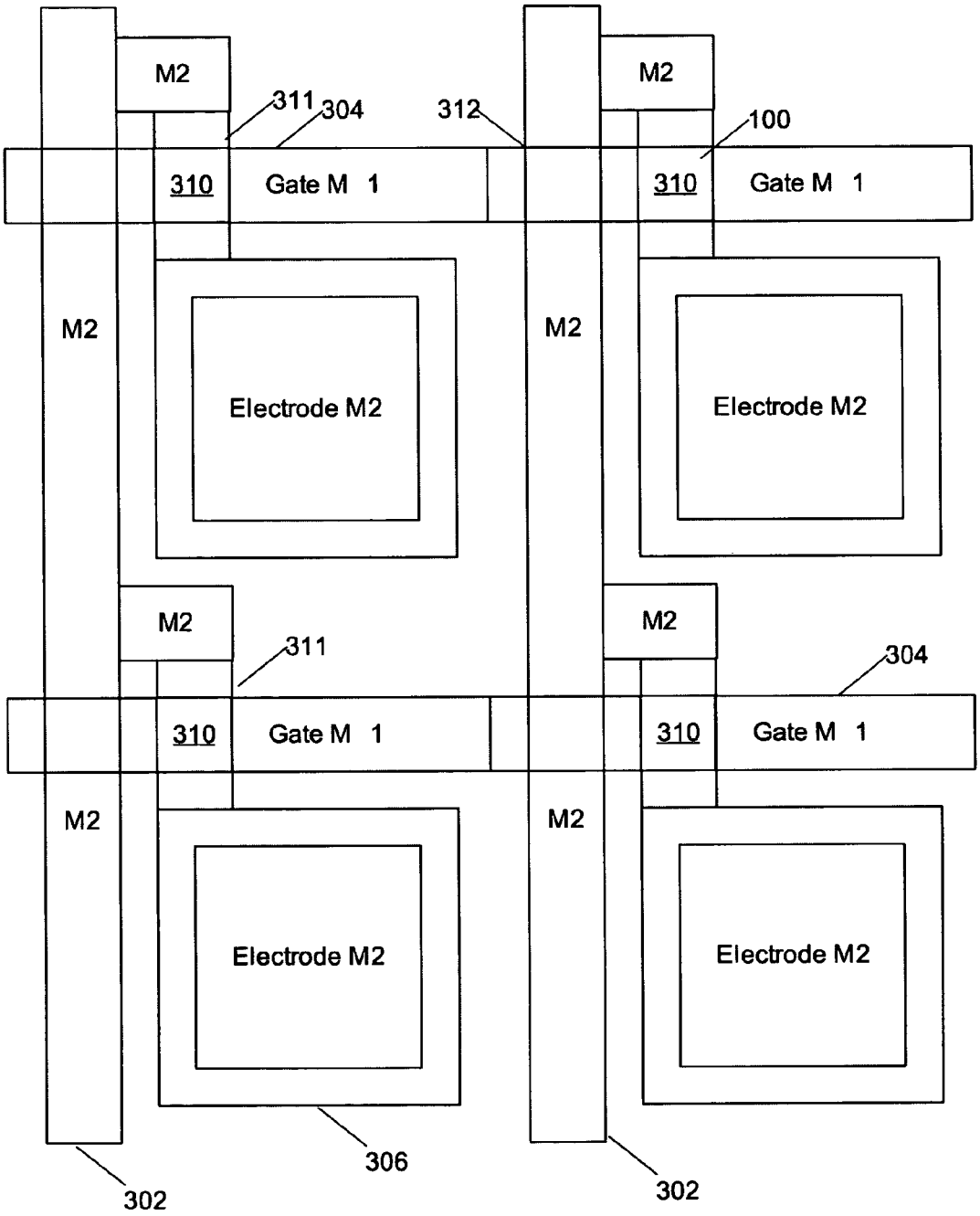
FIG. 3 is a schematic illustration of a small portion of an electrode array.

FIG. 3 illustrates a tiny portion of the electrode array on the surface of image roller 202 or image belt 102. The electrode array has data lines 302, perpendicular to row lines 304. At each intersection of data lines 302 with row lines 304 there is an electrode 306. Electrode 306 is fabricated in second metal layer and connects as drain through thin film transistors 310 to source data lines 302. Thin film transistors 310 are formed as an intersection of gate metal 304 with a silicon region 311. Row lines 306, fabricated in metal layer M1 serve as gates of transistors 310. Jumpers 312 serve to allow continuity of data lines 302 as they cross perpendicular row lines 304 where transistors 310 are not desired.

Figure 4:
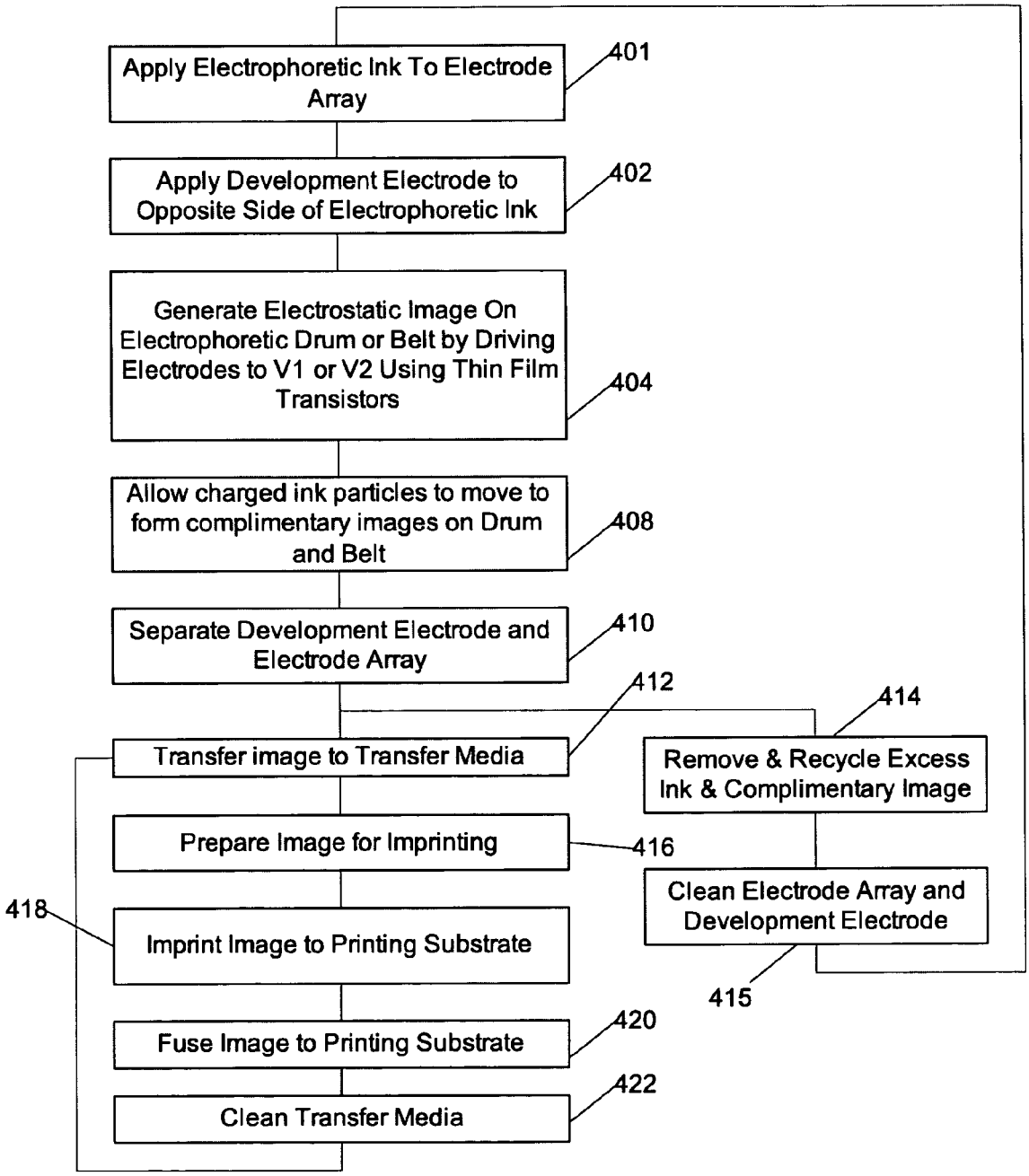
FIG. 4 is a simplified flowchart of printing using the electrode array.
Figure 5A:
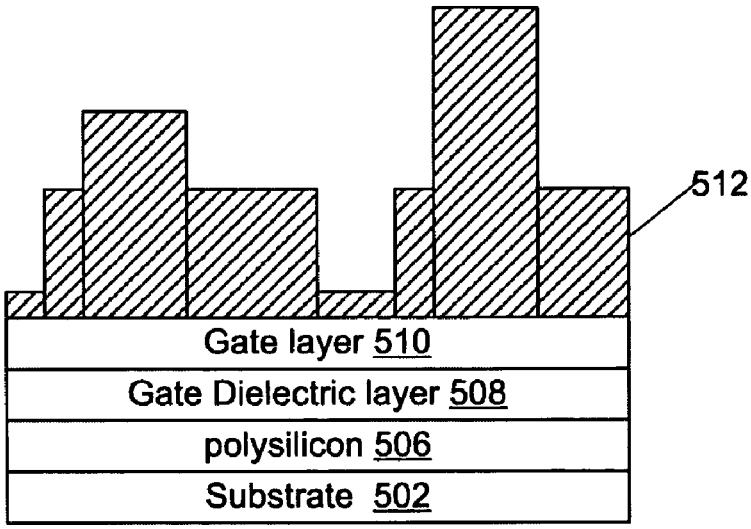
FIGS. 5*a-d* is a sequence of schematic cross sections of the electrode array as it exists at selected points during fabrication using a 4-level imprint; including FIG. 5(*a*) The electrode array after TFT layer deposition and imprinting.
Figure 5B:
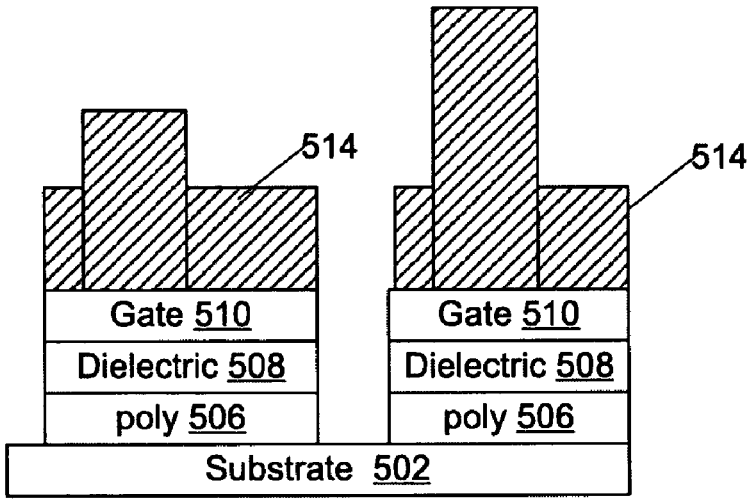
Figure 5C:
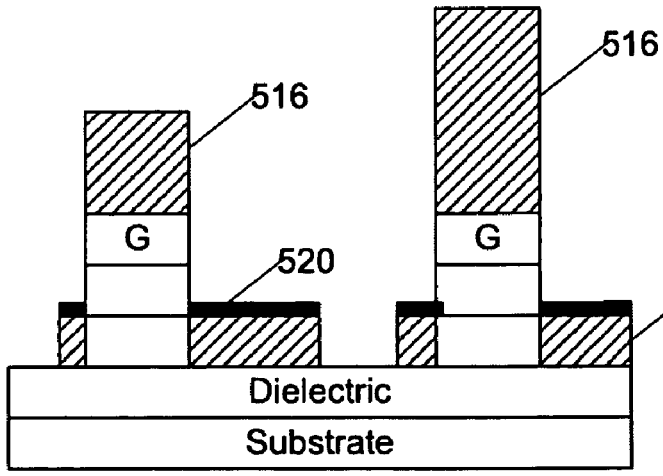
Figure 5D:
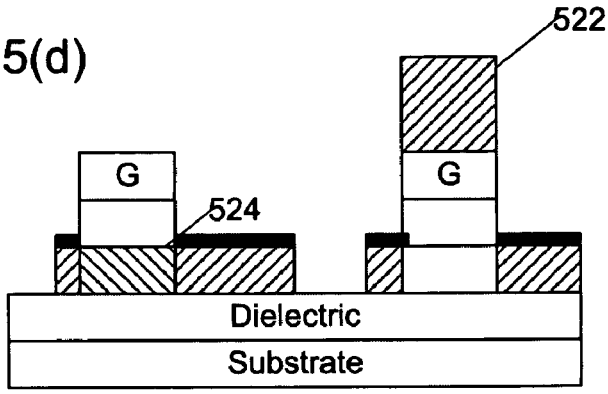
Figure 6A:
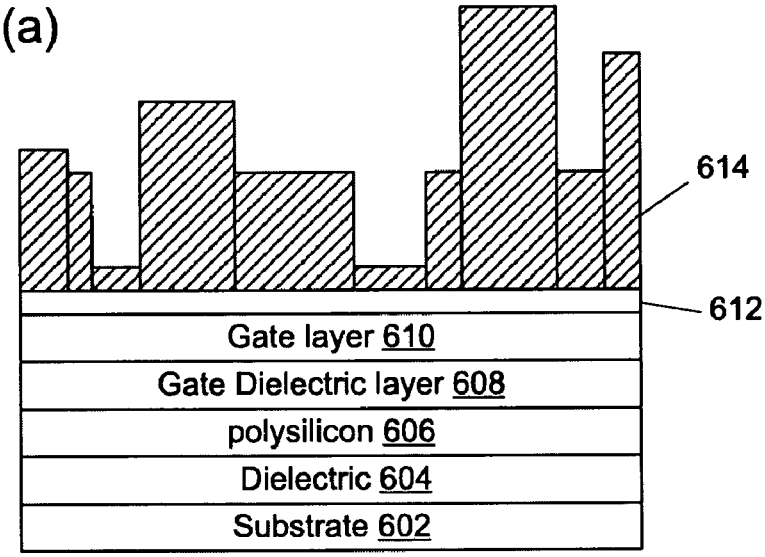
FIG. 6*a-e* is a sequence of schematic cross sections of the electrode array as it exists at selected points during fabrication using a 6-level imprint; including FIG. 6(*a*) The electrode array after TFT layer deposition and imprinting.
Figure 6B:
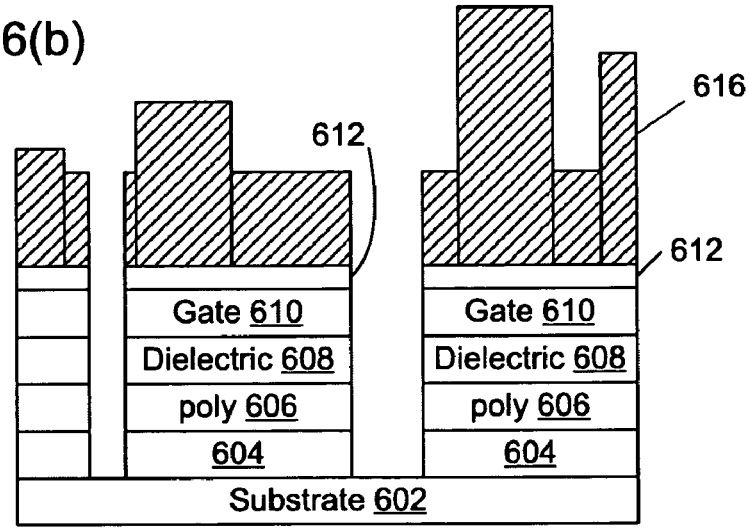
Figure 6C:
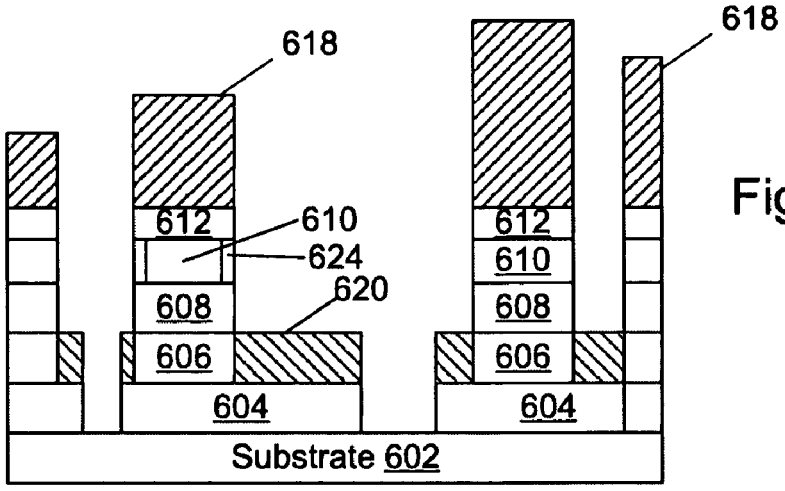
Figure 6D:
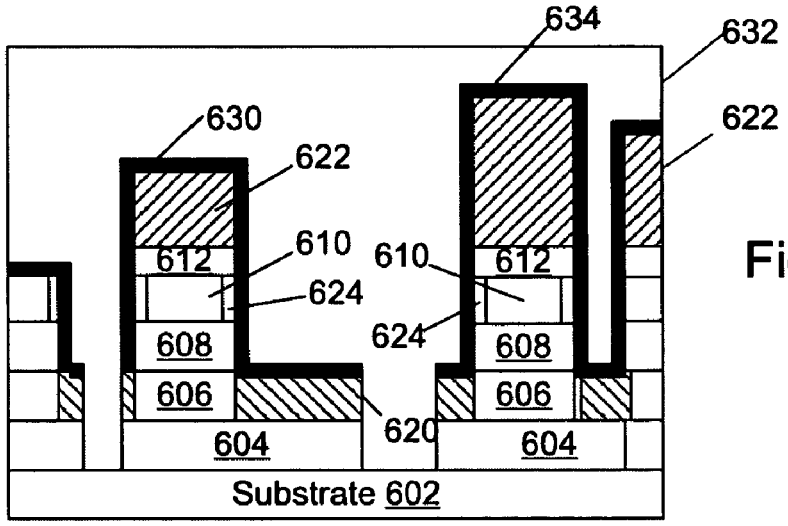
Figure 6E:
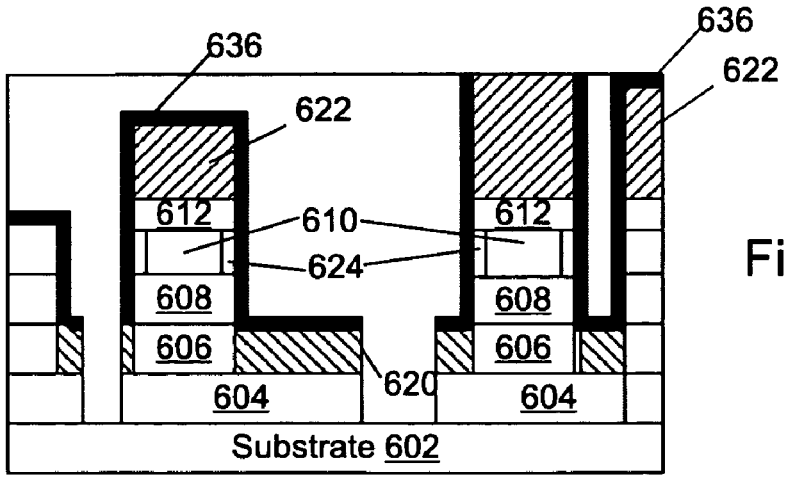

FIG. 4 illustrates the printing process of the printers of FIGS. 1, FIG. 2, and FIG. 2A.

An electrode array is inked 401 with a film of electrophoretic ink containing a suspension of small ink particles in a suitable aqueous or non aqueous liquid component by an ink applicator 108, 208, 258. The ink particles of the ink either have an electrostatic charge, or are neutral particles that accept an electrostatic charge under conditions prevailing in the printer, as known in the art of electrophoretic inks. The ink enters passivation openings in the electrode array and contacts the electrodes of the array. A development electrode 110, 210, 260 is applied 402 opposite the electrode array.

Power, processor, and memory 104, 204, 254 receive information descriptive of a desired image from a host computer (not shown) and control paper feed into the printing mechanism. Power, processor, and memory 104, 204, 254 then generate 404 an electrostatic image on image belt 102 or roller 202, 250 by applying a pattern of voltages to data lines 302 representing locations of desired ink spots for a row of electrodes 306 while an associated row line 304 is pulsed to turn on the transistors 310 associated with that row. Each electrode is thereby charged to one of at least two possible voltages, a first possible voltage V1 and a second possible voltage V2.

In order to allow for current conduction through an aqueous medium of ink, the electrode array of the image belt 102 or image roller 202, 250 may be scanned at high speed to refresh each electrode 306 for which charge is desired as charge is lost into the medium.

The development electrode 110, 210, 260 is connected to a third voltage V3, typically between V1 and V2, and time is allowed 408 for the ink particles to migrate onto image belt 102 or roller 202, or onto development electrode 260, under influence of the electric field to develop complimentary images on the electrode array and on the development electrode. Each electrode of the electrode array develops a pixel of the images.

The development electrode 110, 210, 260 is separated 410 from the image electrode, such as image belt 102 or image roller 202, 250, and squeegee is performed to remove excess ink. One of these complimentary images is transferred 412 from the image electrode, or from the development electrode, to transfer media, such as transfer roller 120, 220, 270, the other is removed 414 as excess ink and recycled. The development electrode 110, 210, 260 and the electrode array on image belt 102 or image roller 202, 250 are then cleaned 415 and the electrodes are recycled.

The image on transfer media is prepared 416 for transfer to the printing substrate, for example by evaporating the liquid component of the ink, and then imprinted 418 onto printing substrate. The particles that make up the image are fused 420 to the printing substrate, and the transfer media is cleaned 422 and recycled. In an embodiment fusing 420 is accomplished by heating the image while on the transfer media such that ink particles are melted before being imprinted onto the printing substrate. In alternative embodiments a separate fuser after image transfer to the printing substrate may be used.

The electrode array is fabricated with a self-aligned imprint lithography (SAIL) process. For the printer designs illustrated, this electrode array must be fabricated on either a curved substrate, having form of part or all of cylinder, such as may be used as image roller 202; or alternatively fabricated on a flexible, insulating, substrate such as may be used as part or all of image belt 102. This insulating substrate of the electrode array may be made from an insulating material, or may be made from a conductive material such as metal with an insulating coating.

Self-Aligned Imprint Lithography (SAIL) is a recently-developed technique for producing multilayer patterns on flexible or curved substrates such as belts or drums. Basics of this technique are described in U.S. patent application Ser. No. 10/104,567, US patent publication number 04-0002216, the disclosure of which is incorporated herein by reference. As described in 04-0002216, the SAIL technique uses a four-thickness roll-imprinted resist layer to define an array of perpendicular metal lines of width as small as 100 nanometers on two metal layers. It has been proposed that this technique may be capable of constructing an array of intersecting metal lines having semiconductor devices, such as diodes and transistors, at intersections of the metal lines.

For purposes of this document, the term "Self Aligned Imprint Lithography" shall mean any lithography technique used for definition of regions of thin film transistors wherein a roll-imprinted resist layer having three or more thicknesses is used to define regions of the transistors.

A first embodiment of this process is illustrated in FIGS. 5(*a*), 5(*b*), 5(*c*) and 5(*d*). In this embodiment, an insulating substrate 502 is coated successively (FIG. 5(*a*)) with a polysilicon layer 506, a gate dielectric layer 508, and a gate metallization layer 510. The gate metallization layer 510 is then coated with a roll-imprinted, ultraviolet-cured polymeric, resist layer 512 having multiple levels. For some steps the resist layer may be used directly, or may be used to pattern an underlying oxide layer with matching multiple levels.

The thinnest areas of the resist layer are removed, as illustrated in FIG. 5(*b*) with an etching process, somewhat thinning but leaving present islands of thicker portions 514 of the resist areas. An etch is performed through the openings thus made to remove portions of polysilicon layer 506, gate dielectric layer 508, and gate metallization layer 510.

The thinnest remaining areas of the resist layer are removed, as illustrated in FIG. 5(*c*) with an etching process, somewhat thinning but leaving present islands of thicker portions 516 of the resist areas where gate metal 510 will remain in the finished circuit. An etch is performed through the openings thus made to remove portions of gate dielectric layer 508, and gate metallization layer 510, leaving the underlying polysilicon layer 506. A source-drain implant 518 is performed through the openings thus made, and a low-resistance metal coating 520 may be applied to the source and drain regions by reacting suitable chemicals with exposed polysilicon.

The thinnest remaining areas of the resist layer are removed, as illustrated in FIG. 5(*d*) with an etching process, somewhat thinning but leaving present islands of thicker portions 522 of the resist areas where active transistors will remain in the finished circuit. A shorting implant 524 is performed through the openings thus made to provide continuity in data lines as they jump row lines. The remaining portions 522 of resist are then removed.

A second embodiment of this process is illustrated in FIGS. 6(*a*), 6(*b*), 6(*c*), 6(*d*) and 6(*e*). In this embodiment, an insulating substrate 602 is coated successively (FIG. 6(*a*)) with a thick dielectric layer 604, a polysilicon layer 606, a gate dielectric layer 508, a gate metallization layer 610, and an inter-metal insulation layer 612. The inter-metal insulation layer 612 is then coated with a roll imprinted, ultraviolet-cured polymeric, resist layer 614 having multiple levels, six levels being illustrated. For some steps the resist layer may be used directly, or may be used to pattern an underlying oxide layer with matching multiple levels.

The thinnest areas of the resist layer are removed, as illustrated in FIG. 6(*b*) with an etching process, somewhat thinning but leaving present islands of thicker portions 616 of the resist areas. An etch is performed through the openings thus made to remove portions of polysilicon layer 606, gate dielectric layer 608, inter-metal insulation layer 612, and gate metallization layer 610. The etch is performed deeply into dielectric 604 to prevent later second metal 630 from bridging between islands.

The thinnest remaining areas of the resist layer are removed, as illustrated in FIG. 6(*c*) with an etching process, somewhat thinning but leaving present islands of thicker portions 618 of the resist areas where gate metal 610 will remain in the finished circuit. An etch is performed through the openings thus made to remove portions of gate dielectric layer 608, inter-metal insulation layer 612, and gate metallization layer 610, leaving the underlying polysilicon layer 606. A source-drain implant 620 is performed through the openings thus made. Gate metal 610 is etched back slightly to create an insulating sidewall 624 on each portion of gate 610.

The thinnest remaining areas of the resist layer are removed, as illustrated in FIG. 6(*d*) with an etching process, somewhat thinning but leaving present islands of thicker portions 622 of the resist areas where inter-metal insulation 612 will remain in the finished circuit. Contacts between gate metal 610 and second metal 630 are formed by the regions just removed. An etch is performed through the openings thus made to remove portions of inter-metal insulation layer 612. A second metal layer 630 is then applied everywhere except in the deep isolation trenches in dielectric 604. A second polymer layer 632 is applied over the top of the circuit.

While contacts between gate metal 610 and second metal 630 are not used in the electrode array itself, they are extremely useful in any buffer, address, and control circuitry fabricated on and with the electrode array. Buffer, address, and control circuitry is useful for receiving an image from the processor and driving row and column lines in response to the image. In an alternative embodiment of a cylindrical electrode array, buffer, address, and control circuitry for receiving an image from the processor is fabricated with conventional technology and attached to the cylindrical electrode array.

The circuit is then planarized by electromechanical polishing to remove top portions of the second polymer layer 632 and portions 634 of second metal 630 that are on top of tallest portions of the resist layer, while exposing portions of electrodes 634 that are on next-tallest portions of resist islands 622, and leaving jumper portions of second metal 636 on next-lowest portions of remaining resist islands 622.

Conventional lithography on flexible substrates is more difficult at small linewidths and precise alignments than at coarse linewidths and alignment. It is anticipated that additional layers, including passivation layers, may be added to the circuit using conventional photolithography. These additional layers may be aligned in part through automatic optical reference to alignment marks in lower, SAIL-fabricated, layers of the circuit.

Reference has been made to transfer rollers 120, 220, 270 for transferring an image from a development electrode or from an image electrode to a printing substrate. These transfer rollers may in some embodiments be replaced with a transfer blanket or a transfer belt. The transfer roller, transfer blanket, or transfer belt, together with any additional intermediate transfer rollers, blankets, or belts, form image transfer apparatus for transferring an image onto a printing substrate.

During electrophoresis, ink particles move at a rate proportional to voltage. When the electrostatic image is generated 404 on the array in an alternative embodiment, the array is charged to voltage V selected from one of many voltages Vn, such as a fourth voltage V4, instead of just to two voltages V1 and V2 as heretofore described. In this embodiment, a number of ink particles roughly proportional to the difference between the applied voltage V and the development electrode voltage V3 deposit on the electrodes to form the image, thereby controlling a density of particles at a pixel of the image. This embodiment is therefore capable of direct grayscale printing or enhanced color printing.

Electrophoretic ink is available in a variety of colors. It is anticipated that an embodiment having four stages, one stage for imprinting each of cyan, magenta, yellow, and black inks, is capable of producing full-color images. An embodiment may have a single image roller with a first ink applicator, development electrode, and squeegee apparatus for cyan ink, a second ink applicator, development electrode, and squeegee apparatus for magenta ink, a third ink applicator, development electrode, and squeegee apparatus for yellow ink, and a fourth ink applicator, development electrode, and squeegee apparatus for black ink, these applicators are located in any order around the image roller. In an alternative embodiment, four sets of image rollers, ink applicator, development electrodes, and squeegee apparatus transfer images into a common image transfer apparatus that in turn transfers the image onto a printing substrate.

The electrode array heretofore discussed resembles a dynamic memory circuit, in that to hold a voltage for any significant time it must be refreshed. In an alternative embodiment requiring more complex processing than that discussed herein, the electrode array has complimentary column lines, power and ground lines and a six-transistor full-complimentary static memory cell at each electrode.

While the invention has been particularly shown and described with reference to particular embodiments thereof, it will be understood by those skilled in the art that various other changes in the form and details may be made without departing from the spirit and scope of the invention. It is to be understood that various changes may be made in adapting the invention to different embodiments without departing from the broader inventive concepts disclosed herein and comprehended by the claims that follow.

What is claimed is:

1. An electrographic printer comprising:

an electrode array further comprising a plurality of row lines, a plurality of data lines perpendicular to the row lines, and a plurality of thin-film transistors having a source at the data lines, drain at electrodes of the array, and gates at the row lines;

a processor for placing a voltage selected from at least a first and a second voltages on each of the plurality of data lines of the electrode array and for driving the row lines of the array;

a first ink applicator for applying electrophoretic ink to the electrode array, the electrophoretic ink comprising charged particles in a liquid component;

a development electrode charged to a third voltage for developing an image of charged ink particles;

image transfer apparatus for transferring the image to a printing substrate; and ink removal apparatus for removing excess ink from the electrode array.

2. The electrographic printer of claim 1, wherein the electrode array is fabricated on a surface of a roller.

3. The electrographic printer of claim 1, wherein the electrode array is fabricated on a surface of a flexible belt.

4. The electrographic printer of claim 1, wherein the electrode array is fabricated by a process comprising self-aligned imprint lithography.

5. The electrographic printer of claim 4, wherein the processor is capable of placing a voltage selected from a third and a fourth voltage on each of the plurality of data lines, and wherein the voltage applied to the data lines controls a density of ink particles for at least one pixel of the image.

6. The electrographic printer of claim 4, further comprising a paper feeder for feeding paper to the image transfer apparatus, and a paper stacker.

7. The electrographic printer of claim 6, further comprising a second, third, and fourth applicator, wherein the first ink applicator applies a cyan ink, the second ink applicator a magenta ink, the third ink applicator applies a yellow ink, and the fourth ink applicator applies a black ink; and wherein the electrographic printer is capable of printing in color.

8. A method for printing using an electrode array, the electrode array comprising electrodes and transistors, comprising:

applying an electrophoretic ink containing charged ink particles to the electrode array;

charging a plurality of electrodes of the electrode array to one of at least a first and a second possible voltages in an imagewise fashion to produce an electrostatic latent image on the electrode array, wherein charging of each electrode of the plurality of electrodes is performed through a transistor of the electrode array, and wherein an electrode of the electrode array charged to the first possible voltage corresponds to a high particle density and an electrode of the electrode array charged to the second possible voltage corresponds to a low particle density in a pixel of the image;

developing an image of charged ink particles with a development electrode biased to a third voltage, the development electrode placed adjacent to the electrode array;

separating the development electrode from the electrode array; and transferring the image to a printing substrate.

9. The method of claim 8, wherein charging the plurality of electrodes charges selected electrodes to a fourth voltage corresponding to an intermediate particle density in a pixel of the image.

10. The method of claim 8, wherein charging a plurality of electrodes of the electrode array is done by coupling electrodes of the array through transistors to data lines of the electrode array.

11. The method of claim 10, wherein charging the plurality of electrodes charges selected electrodes to a fourth voltage corresponding to an intermediate particle density in a pixel of the image.

12. The method of claim 11, wherein the electrode array is fabricated on a substrate selected from the group consisting of a curved substrate and a flexible substrate.

13. The method of claim 12, wherein the electrode array is fabricated using self-aligned imprint lithography.

14. The method of claim 10, wherein the electrode array is fabricated on a substrate selected from the group consisting of a curved substrate and a flexible substrate using self-aligned imprint lithography.

* * * * *

UNITED STATES PATENT AND TRADEMARK OFFICE

CERTIFICATE OF CORRECTION

PATENT NO. : 7,352,376 B2
APPLICATION NO. : 11/092512
DATED : April 1, 2008
INVENTOR(S) : William D. Holland It is certified that error appears in the above-identified patent and that said Letters Patent is hereby corrected as shown below:

In column 10, line 1, in Claim 7, after "second ink applicator" insert -- applies --.

Signed and Sealed this

Twenty-sixth Day of August, 2008

JON W. DUDAS
*Director of the United States Patent and Trademark Office*